US006390426B1

(12) United States Patent
Berry

(10) Patent No.: US 6,390,426 B1
(45) **Date of Patent: *May 21, 2002**

(54) DEVICE FOR MOUNTING AN ACCESSORY TO A WHEELCHAIR

(75) Inventor: Theodore M. Berry, Coventryville, PA (US)

(73) Assignee: Blackberry Technologies, Pottstown, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/834,756

(22) Filed: Apr. 3, 1997

Related U.S. Application Data

(60) Provisional application No. 60/014,559, filed on Apr. 3, 1996.

(51) Int. Cl.[7] ..... A47B 96/06

(52) U.S. Cl. ..... 248/230.1; 248/230.7; 248/298.1; 280/304.1

(58) Field of Search ..... 248/230.1, 230.7, 248/229.16, 224.7, 231.81, 298.1, 282.1, 285.1, 447, 447.2, 276.1, 284.1, 451, 450, 102; 280/304.1; 403/109.1, 109.7, 378, 379.5, 374.3, 290; 297/379.4, 158.2, 188.21, 188.18

(56) References Cited

U.S. PATENT DOCUMENTS 367,175 A * 7/1887 Bachlott ..... 248/207
376,593 A * 1/1888 Greenawalt ..... 248/447
604,008 A * 5/1898 Hughes ..... 248/447.2
606,924 A * 7/1898 Hale ..... 248/451
620,833 A * 3/1899 Easom ..... 403/379.4
790,217 A * 5/1905 Mason ..... 108/1
1,187,845 A * 6/1916 Kolb ..... 248/102
1,328,476 A * 1/1920 Averill ..... 248/447
2,994,501 A * 8/1961 Barnard ..... 248/231.61
3,032,783 A * 5/1962 Swanson, Jr. ..... 248/285.1
3,709,556 A * 1/1973 Allard et al. ..... 297/188
4,270,721 A * 6/1981 Mainor ..... 248/285
4,742,981 A * 5/1988 Converse ..... 248/231.7
5,161,766 A * 11/1992 Arima ..... 248/447
5,374,074 A * 12/1994 Smith ..... 280/304.1
5,482,239 A * 1/1996 Smith ..... 248/229.13
5,509,680 A * 4/1996 Scharf ..... 280/304.1
5,630,566 A * 5/1997 Case ..... 248/122.1
5,671,900 A * 9/1997 Cutler ..... 248/451
5,704,627 A * 1/1998 Davis et al. ..... 280/304.1
5,765,911 A * 6/1998 Sorenson ..... 297/173

* cited by examiner

*Primary Examiner*—Anita King
*Assistant Examiner*—Gwendolyn Baxter
(74) *Attorney, Agent, or Firm*—Dann, Dorfman, Herrell and Skillman; Stephen H. Eland

(57) ABSTRACT

A modular apparatus for mounting various accessories to a wheelchair is provided. The apparatus includes a telescoping mounting bar removably mounted onto the frame of a wheelchair below the seat. Attached to the telescoping bar is an accessory mount for mounting accessories onto the bar. Several accessories are provided including an articulating arm, a gun mount, an adjustable tray, a fishing rod holder and a basket holder.

24 Claims, 7 Drawing Sheets

DEVICE FOR MOUNTING AN ACCESSORY TO A WHEELCHAIR

This application claims the benefit of provisional application No. 60/014,559, filed Apr. 3, 1996.

FIELD OF THE INVENTION

The present invention relates to an apparatus for mounting an accessory to a wheelchair. Specifically, the present invention relates to a telescoping mounting apparatus removably mountable upon a wheelchair. In addition, the present invention relates to accessories removably mountable on a wheelchair. More specifically, the present relates to wheelchair accessories including an articulating arm, a gun mount, an adjustable tray, a fishing rod holder, and a basket holder.

SUMMARY OF THE INVENTION

The present invention provides a novel mounting apparatus for removably mounting accessories onto a wheelchair. The present mounting apparatus is used in connection with wheelchairs having a frame supporting a seating. The mounting apparatus includes a telescoping bar having proximal and distal ends. A pair of bar mounts mount the telescoping bar to the wheelchair frame below the seat. An accessory mount is attached to the telescoping bar for mounting the accessory onto the mounting apparatus.

BRIEF DESCRIPTION OF THE DRAWINGS

All of the objects of the present invention are more fully set forth hereinafter with reference to the accompanying drawings, wherein.

DETAILED DESCRIPTION OF THE PREFERRED EMBODIMENTS

The Uni-Mount System is an integrated modular system 10 designed to mount on any sized wheelchair 5, manual or electric, to hold a variety of attachments or accessories to assist the wheelchair user in daily activities, sports and recreation.

Figure 1A:
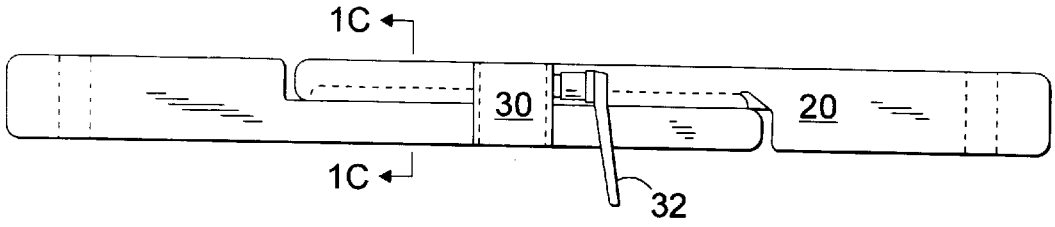
FIG. 1A is a front elevational view of a mounting bar for mounting accessories to a wheelchair.
Figure 1B:
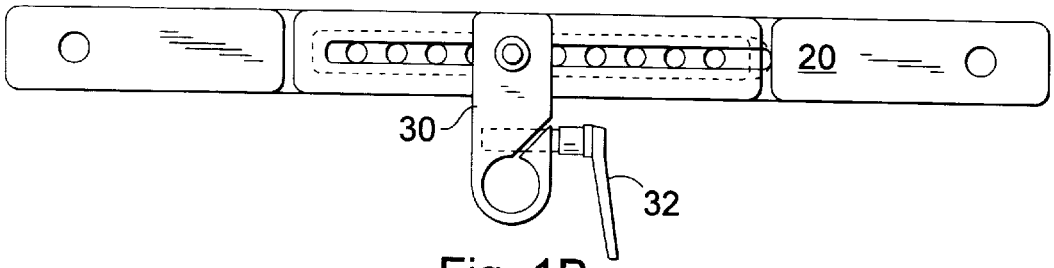
FIG. 1B is a plan view of the mounting bar illustrated in FIG. 1A.
Figure 2A:
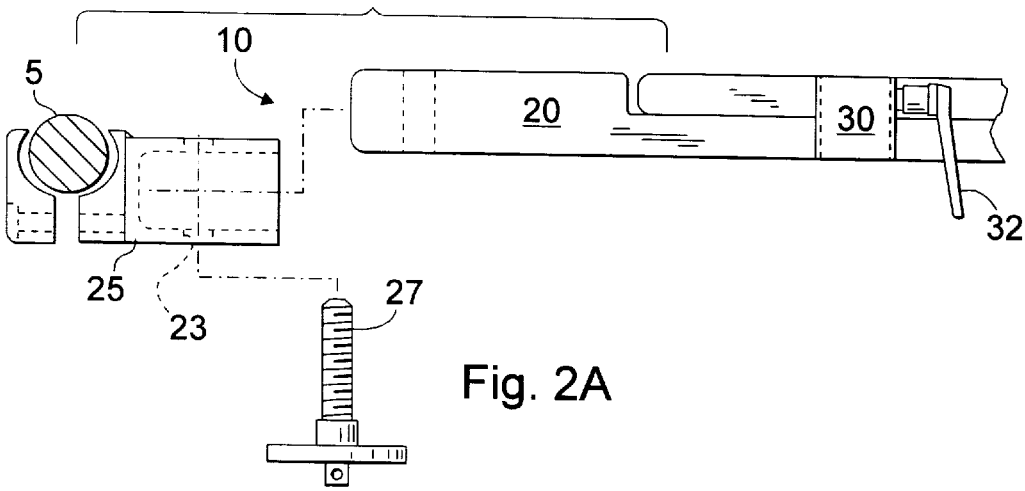
FIG. 2A is a fragmentary exploded side elevational view of a base for mounting an accessory onto a wheelchair, incorporating the mounting bar illustrated in FIG. 1A.
Figure 2B:
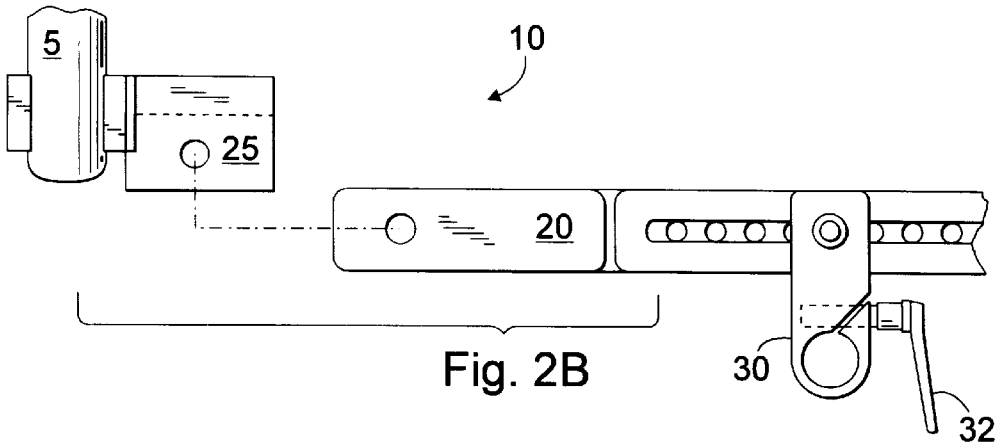
FIG. 2B is a fragmentary exploded plan view of the base illustrated in FIG. 2A.
Figure 2C:
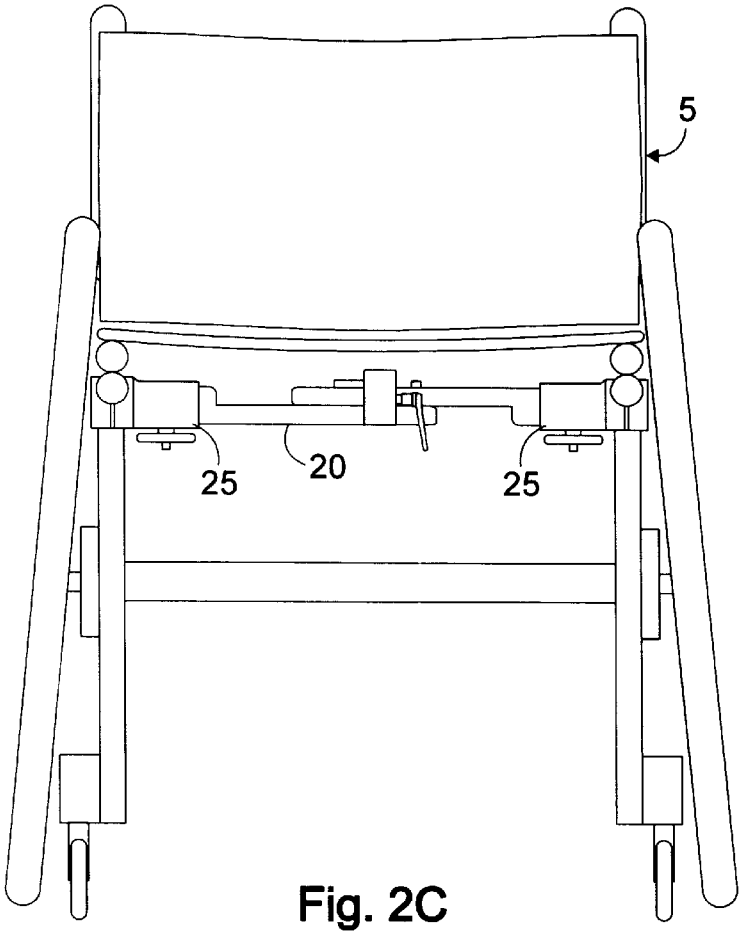

The system's base includes an accessory mount comprising an adjustable width horizontal bar 20 (FIGS. 1A and 1B) which mounts under the wheelchair seat into sockets in two bar-receivers 25 (FIGS. 2A and 2B). Once the horizontal bar 20 is placed into the bar-receivers 25, two double-action quick-release pins 27 (FIG. 2A), one on each end, are slipped through the quick-release pin holes 23,27 in the bar receivers and horizontal bar. This securely holds the assembly together and keeps the horizontal bar 20 from sliding out of the bar receivers 25 once installed. The bar receivers 25 are designed to hold the horizontal bar at an offset from the seat-frame tubes of the wheelchair 5 which support the seat of the wheelchair. This will keep the horizontal bar below the wheelchair seat plane. This feature will protect the user's legs from resting on the horizontal bar which could possibly restrict blood flow through the user's lower extremities. The bar receivers 25 are mounted on the wheelchair's seat-frame tubes towards the front of the wheelchair 5. With this configuration, the system easily can be removed as desired for folding the wheelchair, adjustments or reducing the total weight of the wheelchair. A vertical bar clamp 30 is attached to the adjustable horizontal bar 20. The vertical bar 35 (FIG. 3) mounts through the vertical bar clamp. The relative elevation of the vertical bar is adjustable by means of sliding the bar up and down through the vertical bar clamp fixture and tightening the vertical bar clamp's lock lever 32 which serves as a fastener to secure the accessory to the accessory mount. Various attachments can be mounted onto the vertical bar 35.

This open architecture allows for mounting any number of attachments and accessories, such as the following attachments.

The camera mount 40 (FIGS. 4A,4B) is made up of two pivoting arms 42,44 and a tri-pod head mounting base 46. The first arm 42 slips over the vertical bar assembly 35 (FIG. 3) and pivots about the top of the vertical bar and its collar 37. The first arm 42 of the camera mount can be clamped to prevent rotation about the vertical bar by tightening lever 45. A second arm 44 pivots about the opposite end of the first arm 42. The second arm 44 can be clamped down to prevent rotation about its pivot point by tightening lever 47 on the first arm. Finally, a tri-pod head can be attached to the face of the tri-pod head mounting base 46. A camera, field glasses, telescope, or similar accessories, can be adjusted forward and backwards plus up or down by sliding the vertical bar 35 up or down through the vertical bar clamp 30 or articulating the camera-mount arms 42,44. Once adjusted, the camera or other accessory can be securely locked into position by tightening levers 45 and 47 on the camera mount system and the vertical bar clamp's lock lever 32.

A special tri-pod head has been developed by modifying a BOGEN® #3028 head to slip over the minor diameter shoulder of the tri-pod mounting base 46 and, as such, be incorporated into the body of the tri-pod head. This makes for a shorter, more stable tri-pod assembly relative to the non-pivoting end of the second arm 44.

Figure 5A:
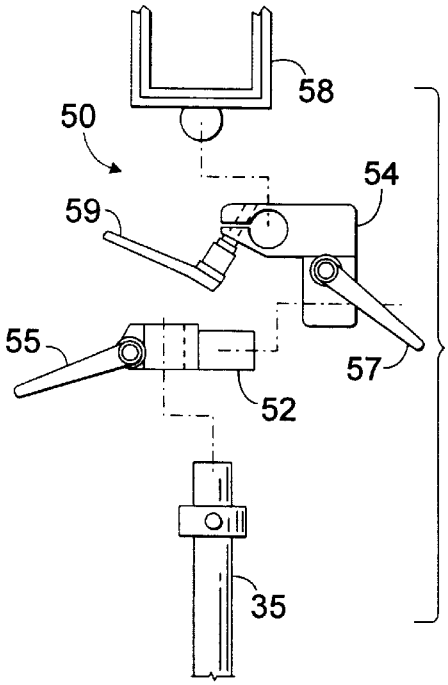
FIG. 5A is a fragmentary exploded side elevational view of a gun mount accessory incorporating a vertical bar operable with the base illustrated in FIG. 2A.
Figure 5B:
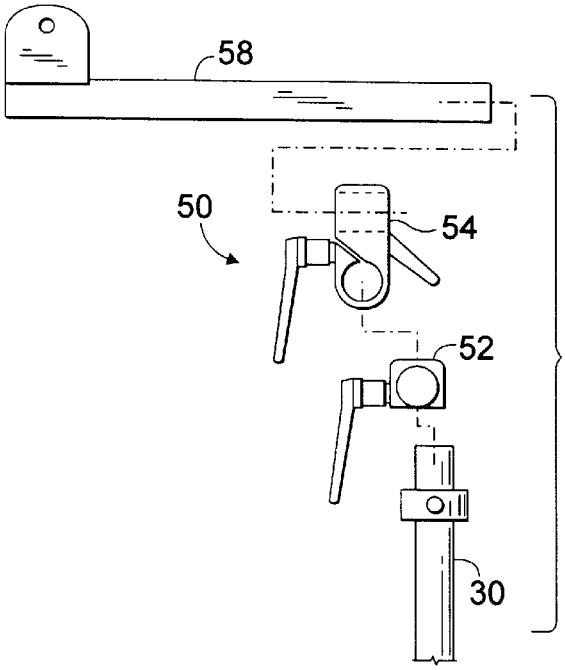
FIG. 5B is a fragmentary exploded front elevational view of the gun mount illustrated in FIG. 5A.

The gun mount 50 (FIGS. 5A and 5B) is made up of two pivoting blocks 52,54 and a sliding clevis assembly 58. The lower block 52 sits on top of the vertical bar 35 and rotates about same. The lower block 52 can be clamped into position and against rotation by tightening lever 55 on the lower block.

The upper block 54 slips over and rotates about the round extension of the lower block 52. The upper block 54 can be clamped into position and against rotation by tightening lever 57 on the upper block. The clevis assembly 58 slips through the upper hole in the upper block 54. Rotation and front-to-back positioning of the clevis assembly 58 can be clamped into position by tightening lever 59 on the upper block 54. With the 90° opposed axis arrangement on the lower block 52, the perpendicular hole orientation of the upper block 54 and the front-to-back plus rotational adjustments of the clevis assembly 58, any angle or elevation can be achieved. By tightening levers 55 and 57 only to snug, i.e. not to full a clamping force of the fixture, the gun mount can hold a gun steady for shooting. This enables the user to adjust the position and elevation, while still having the system hold and control the gun. With this flexibility, the gun mount can be used for hunting as well as target shooting.

Figure 6A:
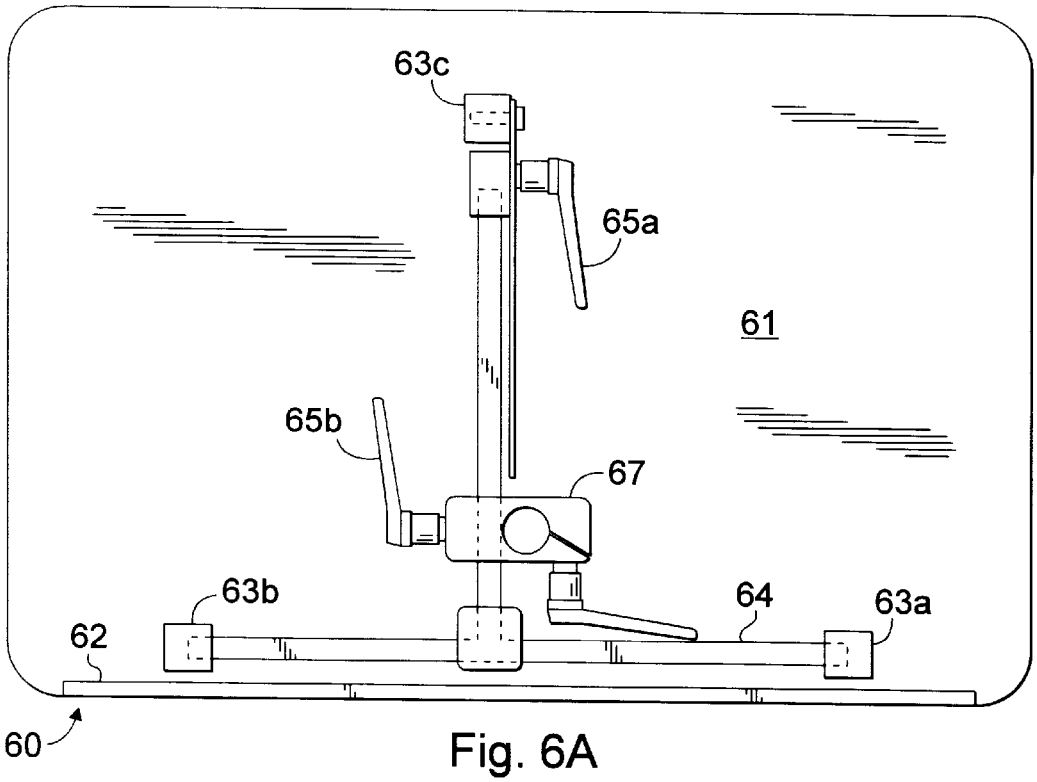
FIG. 6A is a plan view of a tray accessory operable with the mounting bar illustrated in FIG. 3.
Figure 6B:
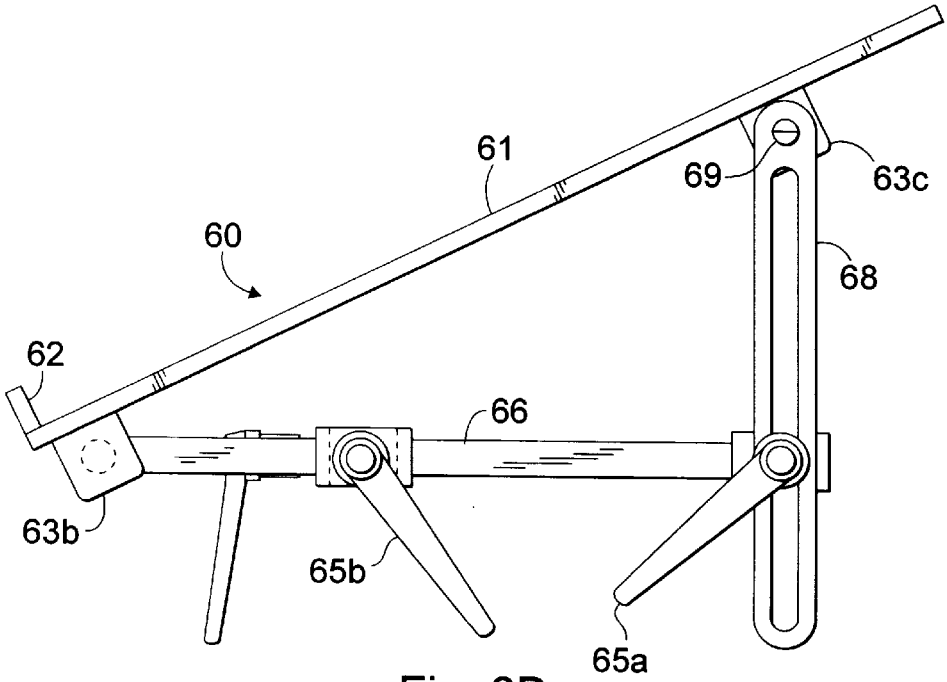
FIG. 6B is a side elevational view of the tray shown in FIG. 6A, illustrating the tray in a tilted position.

The accessory mounted on the accessory mount may comprise a tray or work surface 60. The adjustable tray/work surface 60 (FIGS. 6A,6B) is made up of a PLEXIGLAS® tray 61 with, for safety, rounded corners, edges and bottom lip. The bottom lip 62 acts as a detent against items placed on the tray from falling into the lap of the user. The tray is attached to an adjustable base which allows the tray surface to slide front-to-back plus tilt up from the leading edge 0° to 55° relative to the person sitting in the wheelchair. By pivoting from the leading edge, the work surface will not rotate down into the user's lap when tilted. The tray is translucent to provide the user the ability to still see their lower extremities when the tray is attached. This is psychologically and functionally beneficial for people with disabilities.

Two PLEXIGLAS® pivot blocks 63A,63B are welded to the underside of the PLEXIGLAS® tray just past the leading edge of the tray. The adjustable base assembly is mounted in the pivot blocks 63A,63B which are positioned at each end of the tilt pivot bar 64 (shown in FIG. 6A). This constructs the axis of tilt rotation for the tray system. An elevation bar 66 is fixed perpendicular to the tilt pivot bar (shown in FIG. 6A) such that the center of the vertical mount bar receiver 67 hole is centered side-to-side on the tray. This establishes lateral balance for the tray. The elevation bar 66 can slide front-to-back in the vertical mount bar receiver 67 and can be fixed into position by tightening the front-to-back adjustment lever 65B. This allows the user to adjust the distance between the tray and themselves when sitting in the wheelchair.

Figure 1C:
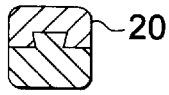
FIG. 1C is a cross-sectional view of the mounting bar illustrated in FIG. 1A taken along line C—C.

A third PLEXIGLAS® pivot block 63C is welded to the underside of the PLEXIGLAS® tray 61 at the distal end of a slotted elevation bar 68. The tray tilt mechanism is made up of the slotted, flat bar 68 which pivots about a pivot bolt 69 set into the third PLEXIGLAS® pivot block 63C and passes through a hole in the non-slotted end of the slotted bar. The tilt lock lever 65A passes through the slot of the slotted bar 68 and screws into the end of the elevation bar 66. Adjusting the tray's tilt angle is accomplished by loosening the tilt lock lever 65A and lifting the upper tray edge up or down as desired. Tilt angle is fixed into position by tightening the tilt lock lever 65A against the tray tilt mechanism. The height of the complete tray assembly is adjustable by loosening the vertical bar clamp 30 (FIG. 1) on the horizontal bar 20 and sliding the vertical bar 35 (FIG. 3) up or down as desired.

Figure 3:
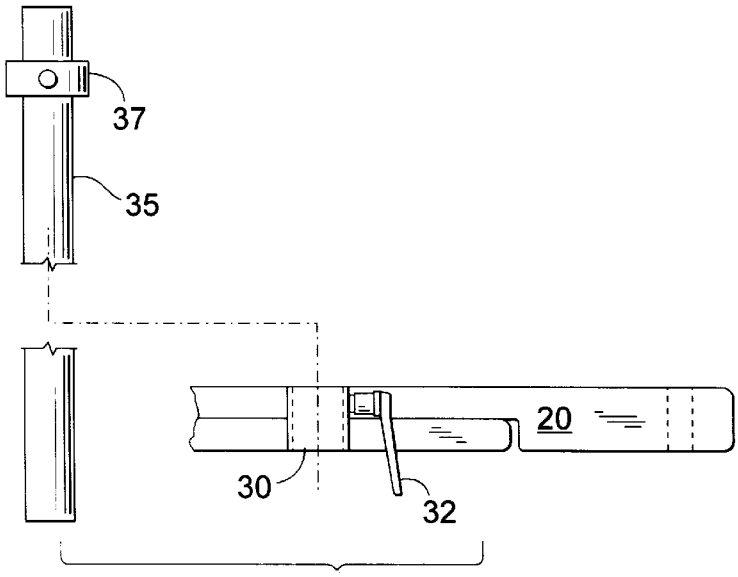
FIG. 3 is a fragmentary exploded front elevational view of the mounting bar illustrated in FIG. 1A incorporating a vertical bar.
Figure 4A:
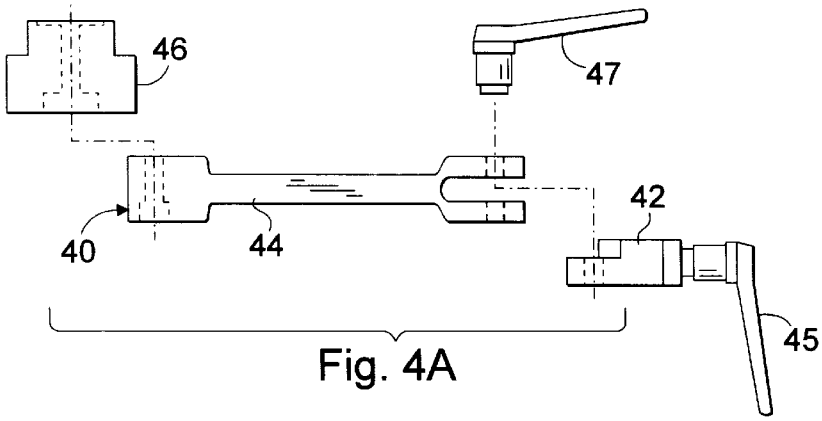
FIG. 4A is an exploded front elevational view of an articulating arm accessory operable with the mounting bar illustrated in FIG. 3.
Figure 4B:
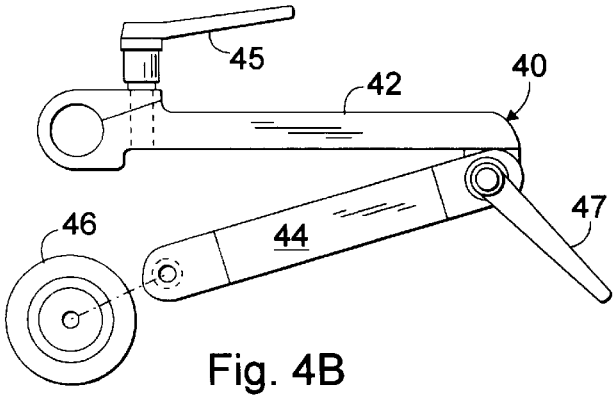
FIG. 4B is an exploded plan view of the articulating arm illustrated in FIG. 4A.
Figure 7:
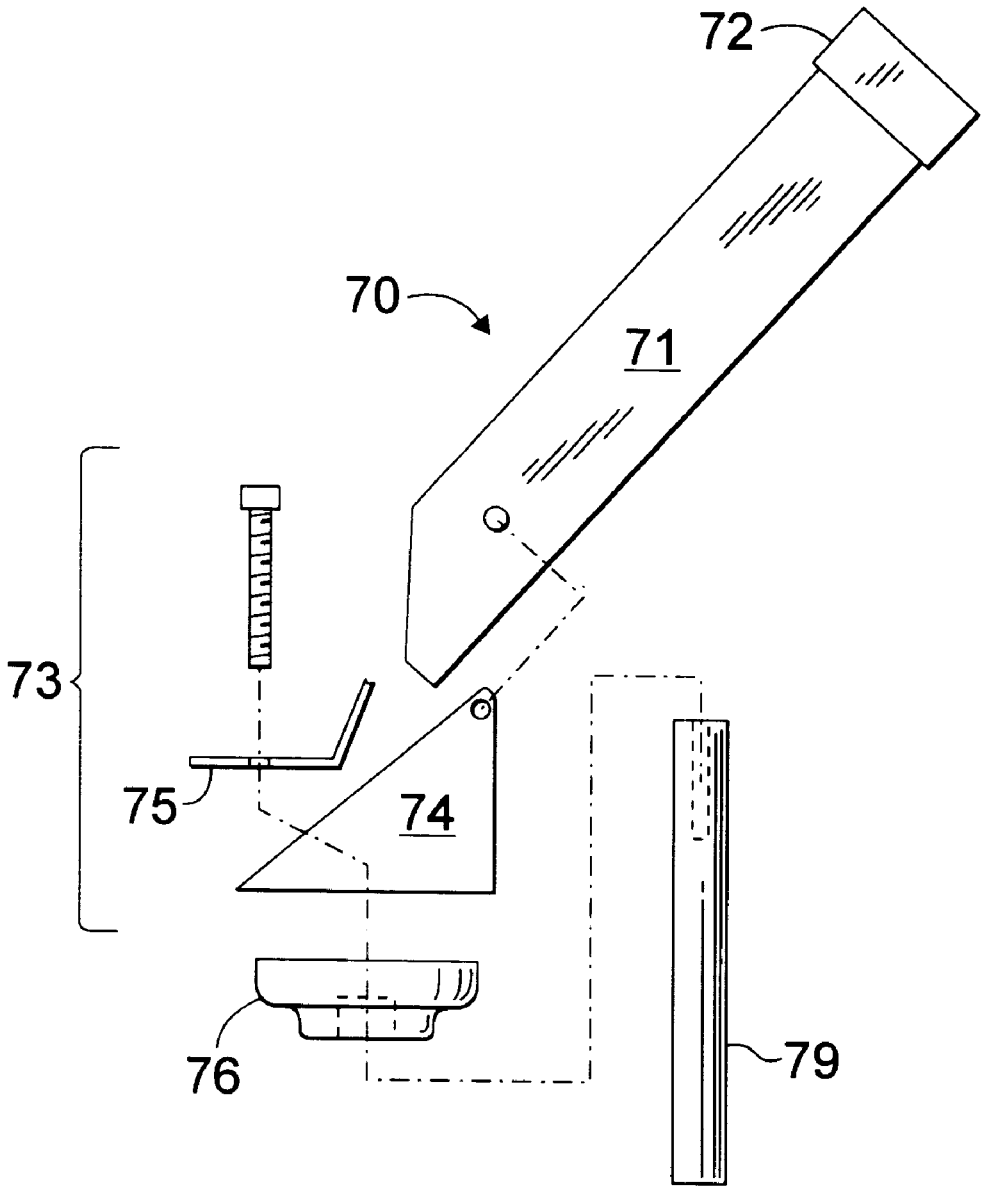
FIG. 7 is an exploded side elevational view of a rod holder accessory operable with the base illustrated in FIG. 2A.

A different accessory comprises a fishing rod 70 (FIG. 7) made up of a stainless steel tube 71 and swivel bracket assembly 73 which is attached to an aluminum base 76 and pole 79. The stainless steel tube 71 has a plastic sleeve 72 over its leading edge to protect the fishing rod and user from being cut by the tube. The tube 71 pivots in its swivel clevis 74. The range of forward rotation of the tube 72 is limited by the swivel detent 75. The intention of having the tube swivel is to allow motion and play of the fishing pole while still providing support. Unlike the aforementioned accessories, the fishing pole holder 70 has a vertical bar 79 incorporated into its design. The vertical bar 35 shown in FIG. 3 is not needed.

Figure 8A:
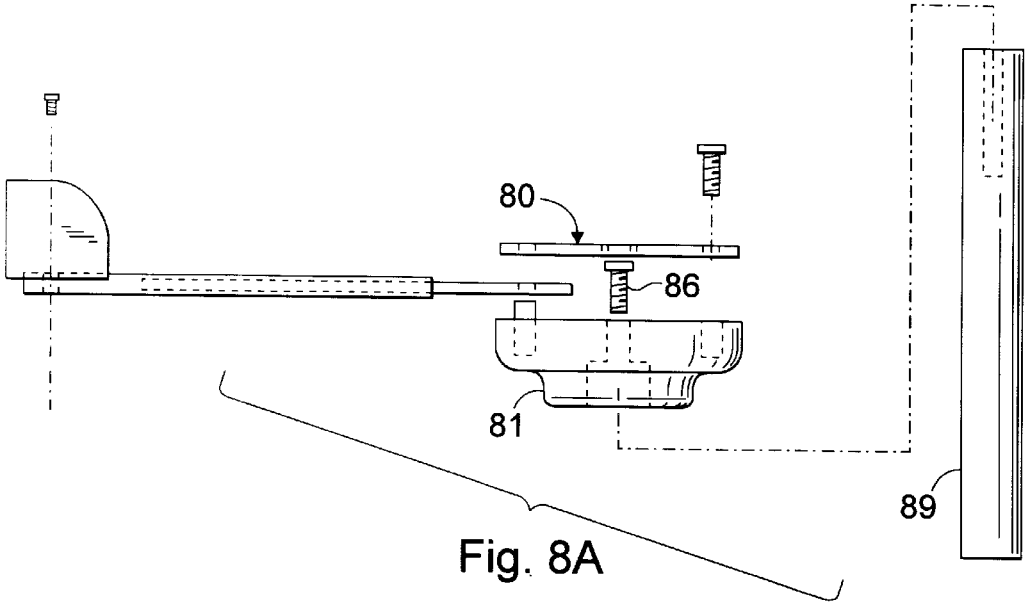
FIG. 8A is an exploded plan view of a basket-holding accessory operable in connection with the base illustrated in FIG. 2A.
Figure 8B:
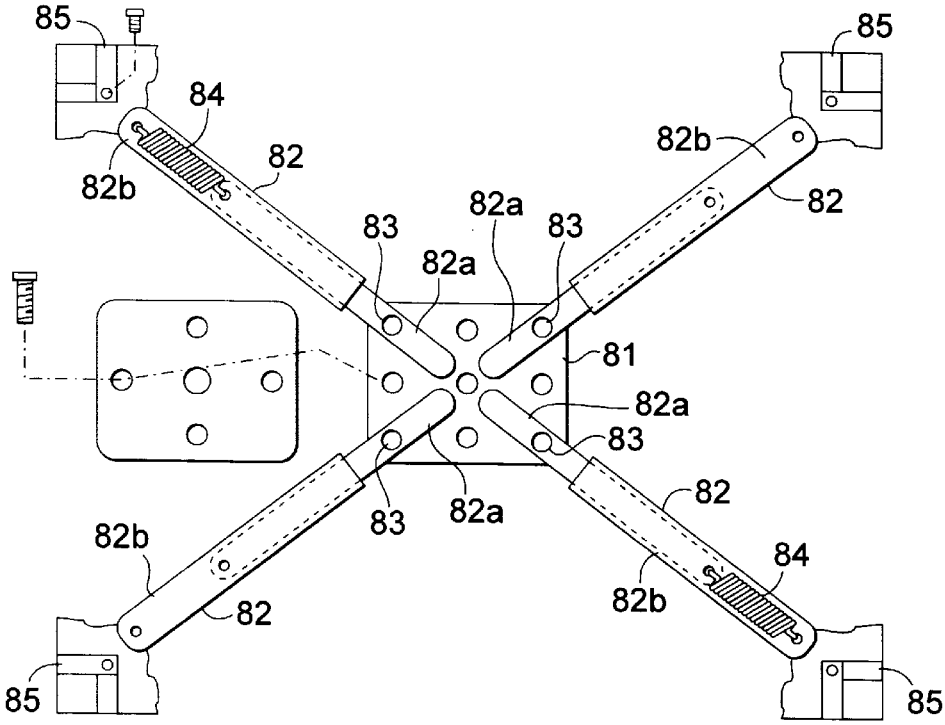
FIG. 8B is a fragmentary exploded side elevational view of the basket-holding accessory illustrated in FIG. 8A.

An additional accessory is shown in FIGS. 8A and 8B. The shopping basket holder 80 is made up of a cradle assembly which is attached to an aluminum base 81 and pole 89. The arms 82 of the cradle assembly are designed to rotate about the support arm pivot points 83 in the aluminum base 81 and extend to accommodate various sized grocery store style hand baskets. Biased against the outer corners of the basket by the clasping springs 84 positioned between and connected to the inner support 82A and outer support arms 82B, retainers 85 pivot relative to the outer support arms and securely press against the sides of the basket, automatically adjusting to the basket's size. The system is attached to the aluminum base 81 and pole by means of a vertical pole bolt 86. The aluminum base 81 and pole 89 are connected to the vertical bar clamp 30 in the horizontal bar 20 (FIG. 3). The shopping basket holder 80 has the pole 89 incorporated into its design so that the vertical bar 35 shown in FIG. 3 is not needed.

While a particular embodiment of the invention has been herein illustrated and described, it is not intended to limit the invention to such disclosures, but changes and modifications may be made therein and thereto within the scope of the following claims.

What is claimed is:

1. An apparatus mounting an accessory onto a wheelchair having a frame supporting a seat, comprising:

a) a telescoping bar having a proximal end and a distal end;

b) first and second bar mounts attached to the wheelchair frame for mounting said bar to the wheelchair frame, wherein said first bar mount comprises a socket for removably receiving the proximal end of said bar and the second bar mount supports the distal end of the bar; and c) an accessory mount attached to said bar intermediate the first and second bar mounts and configured for releasable engagement with the accessory to attach the accessory to the wheelchair for mounting the accessory onto the wheelchair apparatus.

2. The apparatus of claim 1 wherein said bar is removably mounted to the wheelchair frame.

3. The apparatus of claim 1 wherein said accessory mount allows the accessory to be removably connected to said apparatus.

4. The apparatus of claim 1 wherein said second bar mount comprises a socket for removably receiving said distal end.

5. The apparatus of claim 1 comprising a pin passing through said bar to removably connect said bar to said first bar mount.

6. In combination with a wheelchair having a frame and a base mounted on the frame, wherein the base has an accessory mount connected to a telescoping bar, a first bar mount removably connectable with the wheelchair frame, and a second bar mount removably connectable with the wheelchair frame, said first bar mount comprising a socket for releasably receiving the first end of the telescoping bar and the second bar mount being operable to support the second end of the telescoping bar; a wheelchair accessory disposed intermediate the first and second bar mounts, and comprising an elongated member engageable with the accessory mount and a fastener removably connecting said accessory mount to the base.

7. The wheelchair accessory of claim 6 comprising:

a) a first arm pivotally connected to said elongated member;

b) a second arm pivotally connected to said first arm; and c) a mounting head.

8. The wheelchair accessory of claim 7 wherein said mounting head comprises a clevis adjustably connected to said second arm.

9. The wheelchair accessory of claim 7, comprising:

a) a first lock operable to impede said first arm from pivoting with respect to said elongated member; and b) a second lock operable to impede said second arm from pivoting with respect to said first arm.

10. The wheelchair accessory of claim 8 comprising a lock operable to impede said clevis from pivoting with respect to said second arm.

11. The wheelchair accessory of claim 6 comprising a planar tray having an upper edge and a lower edge.

12. The wheelchair accessory of claim 11 wherein said tray is pivotal about a horizontal axis.

13. The wheelchair accessory of claim 12 wherein said horizontal pivot axis is adjacent said lower edge.

14. The wheelchair accessory of claim 6 comprising an elongated tube pivotally connected to said elongated member, and a stop for limiting the pivoting of said tube.

15. The wheelchair accessory of claim 6 comprising:

a) a base;

b) a plurality of telescoping arms pivotally connected to said base, each of said arms having an extended position and a retracted position;

c) a plurality of retaining brackets, each of said brackets being connected to a distal end of one of said arms, each bracket comprising two transverse sides;

wherein said accessory is operable to retain an object placed on said base by telescoping said arms so that said retaining brackets contact said object.

16. The wheelchair accessory of claim 15 wherein said arms comprise a biasing member, biasing said arms towards said retracted position.

17. The wheelchair accessory of claim 15 comprising a plurality of stops limiting the pivoting of said arms.

18. A method for mounting an accessory on to a wheelchair frame, comprising the steps of:

attaching a first bar mount to the wheelchair frame;

attaching a second bar mount to the wheelchair frame so that the second bar mount is spaced apart from the first bar mount;

providing a telescoping bar having an accessory mount;

releasably attaching the telescoping bar to the wheelchair frame by:

attaching one end of the bar to the first bar mount after the first bar mount is attached to the wheelchair frame; and attaching the second end of the bar to the second bar mount after the second bar mount is attached to the wheelchair frame; and attaching an accessory to the accessory mount.

19. The method of claim 18 comprising the step of releasably locking the one bar end to the first bar mount.

20. The method of claim 19 comprising the step of releasably locking the second bar end to the second bar mount.

21. The method of claim 18 wherein the step of attaching the accessory comprises the step of releasably attaching the accessory to the accessory mount.

22. The method of claim 18 comprising the step of removing the accessory from the bar while the bar is attached to the first and second bar mounts.

23. The method of claim 22 comprising the step of removing the bar from the first and second bar mounts while the first and second bar mounts are attached to the wheelchair frame.

24. The method of claim 22 comprising the step of varying the length of the bar after the first bar mount and second bar mounts are attached to the wheelchair.

* * * * *